United States Patent [19]

Bartling et al.

[11] 4,140,072

[45] Feb. 20, 1979

[54] SENSING APPARATUS FOR CYCLICALLY OPERATED APPARATUS

[75] Inventors: Arthur A. Bartling; James J. Lambrecht, both of Milwaukee; Patrick M. Lynch, Franklin, all of Wis.

[73] Assignee: Jos. Schlitz Brewing Company, Milwaukee, Wis.

[21] Appl. No.: 818,560

[22] Filed: Jul. 25, 1977

[51] Int. Cl.[2] ..... B21D 43/00

[52] U.S. Cl. ..... 113/114 C; 72/4; 72/12; 113/1 F; 113/116 QA; 113/121 A; 361/179

[58] Field of Search ..... 113/1 F, 1 R, 121 R, 113/121 A, 121 C, 116 QA, 15 R; 72/4, 12; 361/179; 340/252 B

[56] References Cited

U.S. PATENT DOCUMENTS

| | | | |
|---|---|---|---|
| 2,102,605 | 12/1937 | Bach | 113/114 C |
| 2,136,933 | 11/1938 | Colleson | 113/1 F |
| 3,319,087 | 5/1967 | Wintress | 361/179 X |
| 3,550,546 | 12/1970 | Eicherhorst | 113/1 F |
| 3,641,959 | 2/1972 | Hurst | 113/121 X C |
| 3,656,139 | 4/1972 | Wintress | 72/4 |
| 4,023,044 | 5/1977 | Miller et al. | 72/4 |

*Primary Examiner*—Leon Gilden

*Attorney, Agent, or Firm*—Andrus, Sceales, Starke & Sawall

[57] ABSTRACT

A can lid forming apparatus includes means for attaching a can opening key. A proximity field sensor is mounted in a doming die of the apparatus and generates a pulse logic signal as a can lid with a staked key is formed by the doming tool. A timing disc rotates in synchronism with each cycle of the tool and generates a pair of logic signals. A key monitor circuit is connected to respond to the signals to establish a latch, check latch and reset latch sequence for each cycle of the tooling. If the latch is not set, an appropriate output signal is generated indicating a key is missing from the lid. If the latch is not reset after being set, indicating a build-up of aluminum fines or the like on the probe, an appropriate signal is generated by a preconditioned probe monitoring curcuit. The latter is connected to respond to the pulse logic signal and the reset signal to continuously check on the generation of the output pulse of the probe and produce a stop or alarm output if the logic pulse signal is not formed; indicating a sensor malfunction of the absence of the key.

30 Claims, 10 Drawing Figures

Fig. 1
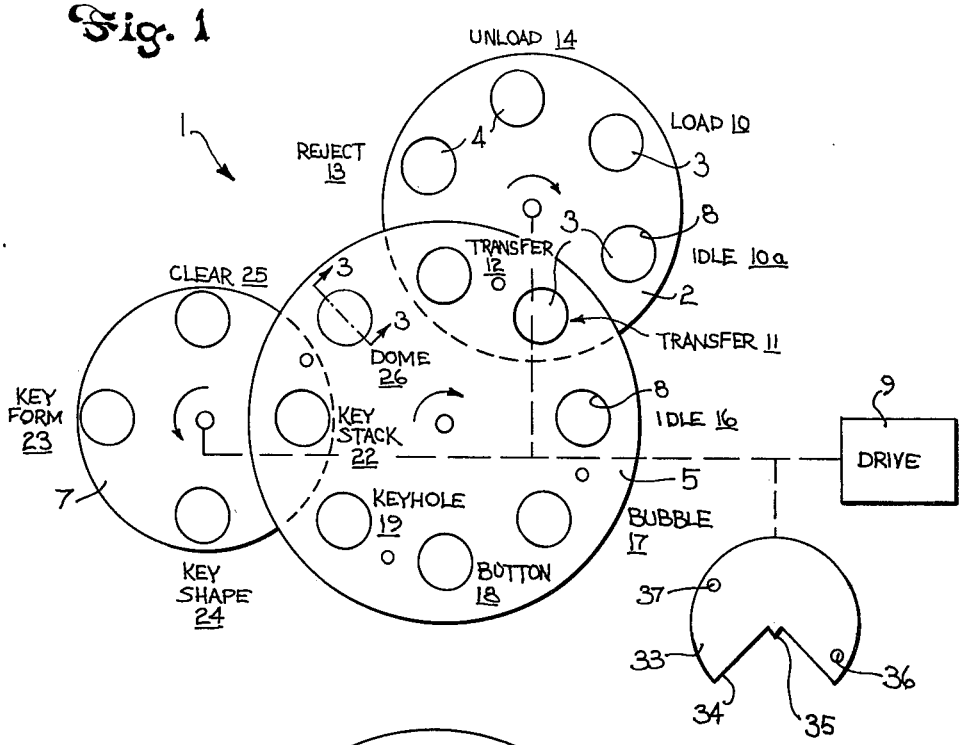
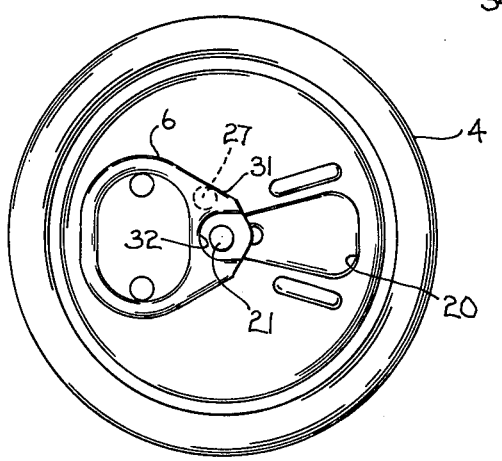
Fig. 2
Fig. 3
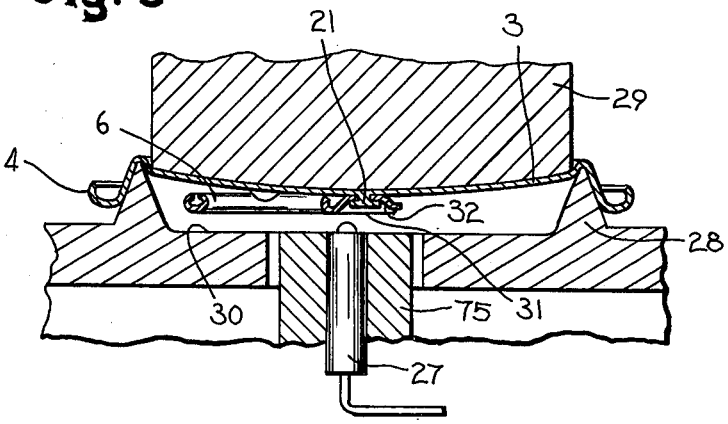

RESET (93)
KEY (54)
CHECK (78)
RESET (70
LATCH (67)(68)
STOP (52)
KEY (55)
RESET (99)
STOP (53)
KEY CHECK MONITOR CIRCUIT
PROBE MONITOR CIRCUIT
MISSING KEY
PUSHBUTTON RESET
SHUTDOWN
CLEANED PROX
SHUTDOWN

CHECK MODE

NOTHING

RESET MODE

NOTHING

KEY SIGNAL

SENSING APPARATUS FOR CYCLICALLY OPERATED APPARATUS

BACKGROUND OF THE INVENTION

This invention relates to an element monitoring apparatus and particularly to such apparatus for continuously monitoring the interconnection of a lid opening key on a can lid.

In cans for beverages and the like, the one end or lid is provided with an opening tab or key which when pivoted outwardly and pulled removes a scored portion of the lid to form a discharge opening. Automated lid forming apparatus has been developed in which the can lid is automatically fed through a series of shaping and forming stations including a key attaching station at which a key is attached. The formed lids are assembled and subsequently applied in a rapid and automated movement to close the filled cans. In such systems, a key monitoring means is provided in the forming apparatus or immediately therefrom to detect missing keys and to reject any lid or end in which the key is missing. If a key is not detected, the forming apparatus preferably stops and permits the operator to check on the type of malfunction. Various key detection systems have been employed.

In one existing key detection system, a spring loaded plunger is located in the forming tool immediately downstream of the station and includes an external arm protruding into alignment with a limit microswitch. The detector switch is normally closed with the key properly in position. If a key is not staked in place, the switch mechanically opens, energizing the appropriate control to terminate press operation and/or providing a signal to an ejection station to eject the appropriate keyless end or lid from the assembly line. In place of the microswitch, a proximity switch can, of course, be provided coupled to the follower arm movement. Other systems have employed monitoring of the presence or lack of a key by use of a proximity switch at a checking station through which each finished lid is moved through the downstream portion of the forming apparatus. In one system, a finished lid is placed in an appropriate belt port and moved past a sensing head. Although such systems are widely employed, the mechanical readjustment of the mechanical force transmission require relatively accurate adjustment which as a result of the high speed operations and the like can readily come out of adjustment with use. In the downstream protection systems, the various monitoring and memory means must be provided to provide the appropriate control and of course require additional machine stations. Further, such systems may not provide a fail-safe operation. Thus if the detection system fails, defective keyless lids can be rapidly produced and fed through the line for the automatic application to the beverage cans. Such cans, of course, cannot be marketed under normal marketing procedures and constitute loss production.

There is a need to provide a more reliable automated key detection means for detecting of the presence of a key and preferably within the downstream forming station.

SUMMARY OF THE PRESENT INVENTION

The present invention is particularly directed to a proximity sensor for detecting of the key element and actuates an electronic system through a sequenced system which positively insures the monitoring of the presence of the keys and providing a fail-safe operation by monitoring the operation of the sensing system. The sensor may be and in accordance with one feature of the present invention, is incorporated within the tool of a forming station, and in particular a doming station which is immediately downstream of the staking station in a can lid forming or conversion press apparatus.

Generally, in accordance with the present invention, a small proximity sensor is mounted within the tooling of the doming station and is operative to provide a binary logic signal in accordance with the monitoring of the presence of the staked key. The proximity sensor unit in a preferred construction is connected to an amplifier unit to form opposite polarity pulses or binary logic signals in accordance with the presence and absence of a key. A cycle control sensor provides position related signals which are operative with the key related signal to establish a key check period and a probe state period during each cycle of the tooling unit. The control means may employ sensor connected to create latch, check latch and reset latch sequence for each cycle of the tooling. If the latch is not set, indicating a key missing, the appropriate fault signal is generated. A sensor malfunction system also generates a fault signal if the sensor signal remains on. A preconditioned probe or sensor monitor circuit is provided in combination with a reset sensor to provide a continuous check on the generation of output pulse of the probe. Thus, if there is a build-up of aluminum fines or the like, the probe monitor curcuit will shut off the press indicating the presence of the "dirty" proximity sensor and stop the press.

The present invention provides a highly reliable and practical key monitoring apparatus for use in high speed conversion lid forming presses and the like.

In a particular, unique embodiment of the present invention, an "all metal" proximity detector or sensor generates a radio frequency field pattern adjacent the head with the output responsive to the location of any metal including aluminum within the field. Such sensors are readily available for rugged industrial application and are relatively small units which can be readily mounted within the cup-shaped tooling die of a lid doming ram press. A timing member operates in synchronism with the doming ram and produces a pair of spaced binary control signals including a check signal and a reset signal. For example, a disc and magnetic flux sensitive switch may control the illumination circuit and thereby the conductivity of phototransistor switches including a check phototransistor switch and a reset phototransistor switch. The key sensor is connected to a suitable amplifier and provides opposite logic signals for correspondingly opposite energizing a pair of photo-transistor relays. The first phototransistor relay is operative to latch a key monitoring circuit and the second relay is operative to actuate a probe condition circuit. The check switch is connected to monitor the setting of the latch circuit to actuate an alarm if the key was missing and the reset switch resets the circuit, unless a "dirty" probe holds the key sensor on. The reset switch is also connected in the probe condition circuit and is operative to actuate the circuit to an alarm state if the probe sensor maintains a key present output as the result of a "dirty" probe sensor.

The system thus employs a first period or checking window in which a key controlled "latch" followed by an automatic "latch check" and "unlatch" sequence is created to sequentially detect the presence of the key, to check if the key has latched the circuit and then to unlatch the circuit and initiate a new cycle. The probe condition monitor during a second period or checking window insures that the signal has changed in each cycle. Although shown created by a particular check sensor means and interrelated relay means, any other suitable means can be employed to generate the several periods. For example, suitable computer means could be employed to sense the proximity sensor output during the cycle and provide the necessary interlocking control.

The present invention has been found to provide a reliable and high speed key detection system. The sensing operation can be completed inside of the tooling without any moving parts, thereby contributing significantly to the reliability and life of the system operation.

BRIEF DESCRIPTION OF THE DRAWINGS

The drawings furnished herewith illustrates a preferred construction of the present invention in which the above advantages and features are clearly disclosed as well as others, which will be readily understood from the following description.

In the drawings:

FIG. 1 is a diagrammatic plan view of a typical can end loading and unloading system, including a plurality of shaping and forming stations for high speed forming of the can ends or lids including the staking of an opening key and checking for the presence of such key;

FIG. 2 is an enlarged plan view of a typical can lid having a staked key;

FIG. 3 is an enlarged vertical section taken generally on line 3—3 of FIG. 1 and illustrating a lid doming station with a sensor mounted in accordance with the teaching of the present invention;

DESCRIPTION OF THE ILLUSTRATED EMBODIMENT

Figures 4A, 4B, 4C, 4D, 4E, 5:
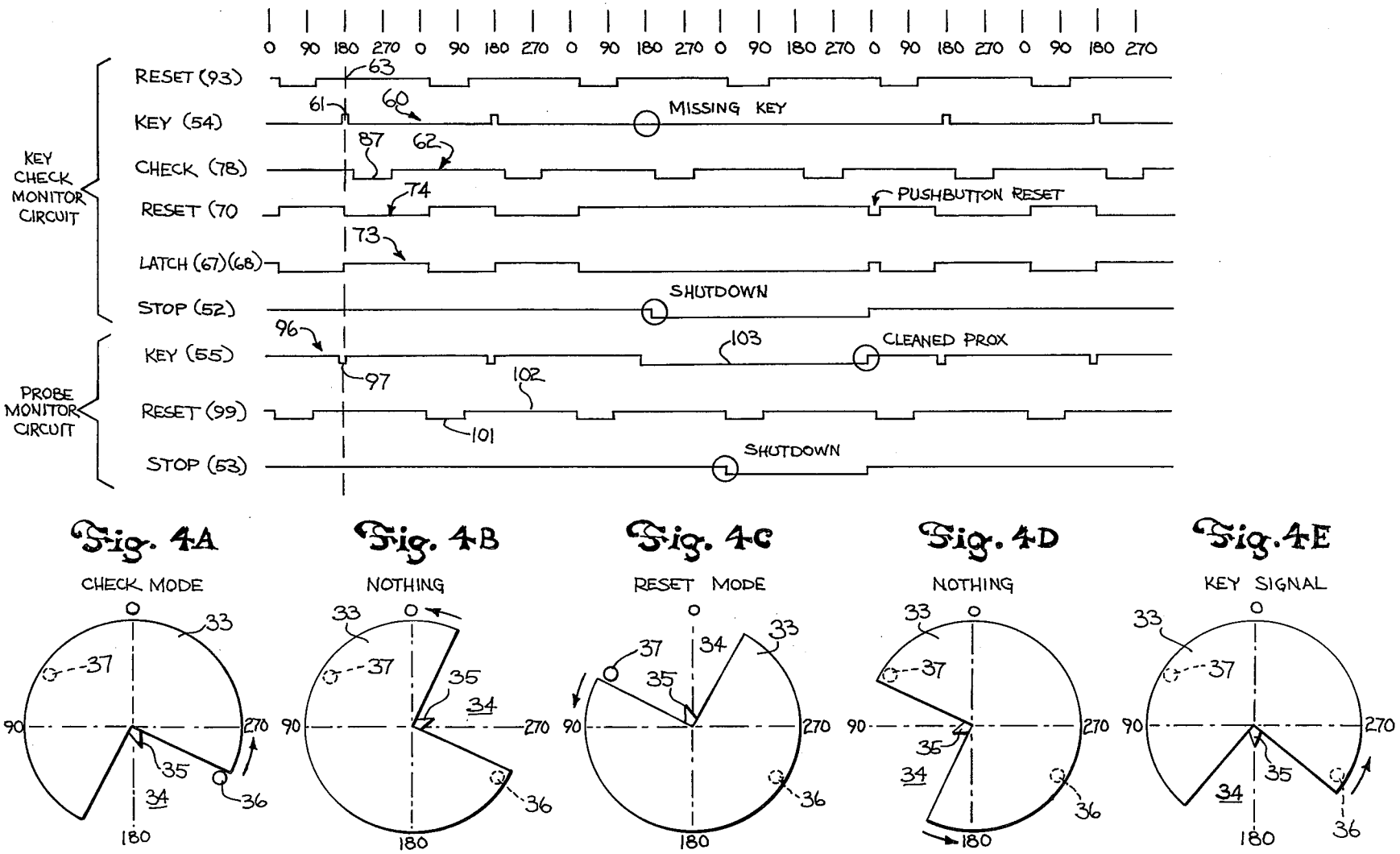
FIGS. 4*a* to 4*e* is a series of illustrations showing alternate sequential positions of a timing plate or disc and associated sequence control sensors.
FIG. 5 is a timing chart showing the logic and control signals generated by the probe sensor, a check sensor and reset sensor during successive cycles of the tool at the doming and key check station.

Referring to the drawings and particularly to FIG. 1, a lid forming and key attaching apparatus 1 of a conventional known construction is diagrammatically illustrated. Generally, in accordance with known construction, the apparatus includes a load-unload dial 2 for successively feeding of unformed lid blanks 3 and receiving of formed lids 4 from a main tooling dial 5. The lid 3 is formed to final domed and lipped configuration shown in FIG. 2 with an opening key 6 centrally staked thereon. A key or tab dial 7 rotates in synchronism with the main tooling dial 5 and is operative to form an appropriate key 6 at a key forming station and, feed it to the main dial 5 where the key 6 is staked to the lid 4. Briefly, each dial includes equicircumferentialy spaced pockets 8 within which a lid is held during synchronized indexing of the dials to move the lids into various forming and shaping stations, including common transfer stations. Each pocket may include suitable spring loaded fingers which hold the can end within the pocket or nest until the completed can end is transferred at the appropriate transfer station.

The three dials 2, 5 and 7 are connected to a suitable drive 9 to rotate or index the several dials in synchronism such that the respective lid pockets 8 are continuously aligned in stepped relation, with each step being separated by a delay period sufficient to permit the various tooling to function and properly effect the shaping and modification to the can lid blank 3.

The load-unload dial 2 includes six stations including a loading station 10 where lid blanks 3 are fed into the apparatus. The indexed dial 2 sequentially moves the lid blank 3 to an idle station 10*a* and then to a transfer station 11 where the lid blank 3 is pushed upwardly into an aligned pocket 8 in the main dial. The emptied pocket 8 of the dial 2 indexes to alignment with a transfer station 12 where a formed lid 4 is transferred downwardly therefrom for subsequent indexing by dial 2 to a reject station 13 where the can end is fed to a reject stack, not shown, if the can end does not have a key or tab 6 or, if a valid keyed lid 4, advances to the unload station 14, completing the cycle.

The main dial 5 is an eight station unit having the equally spaced pockets 8 for successively receiving can lids 3 and sequentially transferring them through the seven stations from transfer station 11. Dial 5 includes an idle station 16, at which a photocell, not shown, may check the presence of a can end 3 and if missing, stop the conversion apparatus for checking and manual insertion of a can end before the cycle 13 reinitiates.

A bubble station 17 includes a punch and die set, not shown, at which a bubble is formed in the can end. Next, a button shaping station 18 having a die tooling changes the bubble to a button shape, as shown in FIGS. 2 and 3.

The main tooling dial 5 then indexes to a key hole scoring station 19 where a hole-shaped severing line 20 is imbedded in the can end 4. The inner end of the line 20 encircles a staking post 21 located essentially at the center of the can end 4. The main dial 5 then is indexed to a tab or key staking station 22, which is common with key dial 7. A key 6 is aligned with the staking post 21.

The tab dial 7 includes four equally spaced cradles including a tab cut station 23, where the key is blanked out of a strip, a tab forming station 24 where the tab is bent for attachment to a can lid, and then to the staking station 22. The fourth station 25 is a clear station where the pocket is cleaned.

A press unit, not shown, is operable to stake the key 6 to the can end 4 at station 22 in appropriate alignment with the inner end of the keyscore line 20, the press unit flattens the post 21 such that the interconnection of the key 6 to the can end 4 is similar to the appearance of the rivet head.

After attachment of the key 6, the main dial 5 indexes to a key detection and doming station 26, where a punch and die form unit, such as shown in FIG. 3, shape the lid with slight inner dome and simultaneously sense for the presence, or lack, of key 6, as more fully discussed hereinafter. If the key is missing, the conversion press apparatus is preferably automatically shut down, and/or a fault signal generated, to permit the operator to determine whether the missing tab is within the tooling or the like. It is important to know that there was a missing tab and to prevent the possibility of forming a large number of unkeyed lids.

After doming and key checking at station 26, the dial 5 moves to the common transfer station 12 with the load-unload dial 2 for transfer thereto and then proper transfer to reject station 13 or unload station 14 for subsequent application to the filled cans.

The final results at the unloading station 14 is a finished lid 4 with the key 6 properly staked to the lid, as illustrated in FIGS. 2 and 3.

Figure 6:
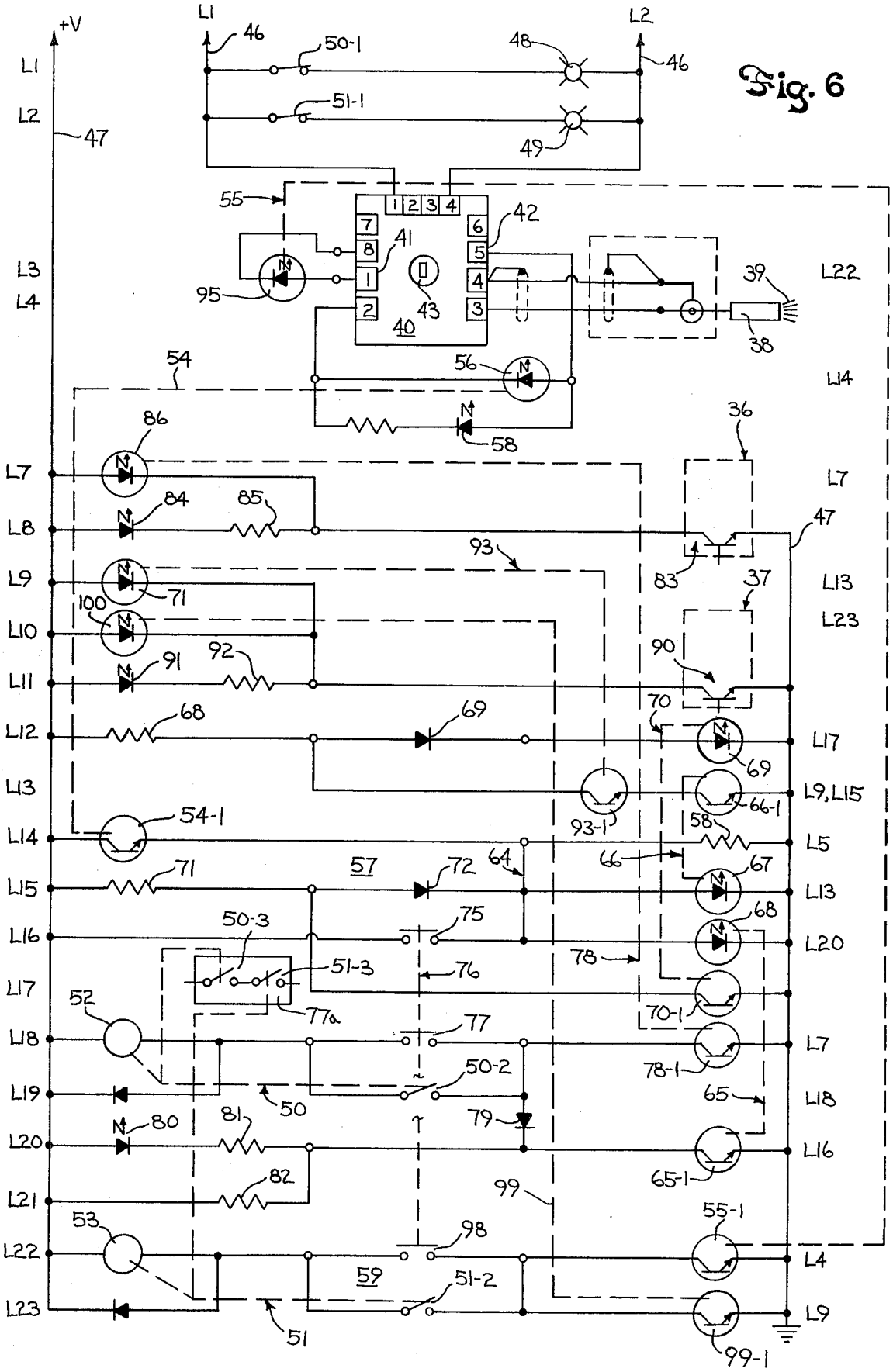
FIG. 6 is an across-the-line schematic circuit incorporating the several sensors and interconnected switching and interlock means to continuously monitor the state of the sensing probe and the response to the key related signals.

The present invention particularly is directed to an improved electronic sensing and monitoring of the presence of the staked key 6 and providing automatic signaling in the absence of a key. In the illustrated embodiment of the invention, a proximity sensor 27 is mounted as a part of the tooling at doming station 26, as shown in FIG. 3 and interconnected into a electronic monitoring circuit, such as shown in FIG. 6. The key sensing is established as presently described during the conventional conversion process and provides reliable and high speed monitoring to insure the presence of a key on all lids transferred to the final unload station 14 of the dial 2.

As the present invention is particularly directed to the key detect system, no further description of the lid conversion apparatus is described other than as necessary to clearly understand the illustrated embodiment of the invention.

Referring particularly to FIG. 3, the doming tooling includes a conventional doming ring die 28 with the outer ends shaped to align with the indented annular ring on the outer peripheral portion of the can lid 3. An aligned doming ram 29 moves downwardly to force the central portion of the lid 3 with the interconnected or staked key 6 partially into the doming ring die 28, with the central portion of the lid 3 and key 6 in spaced relation to the inner base 30 of the ring die 28. The proximity sensor 27 in accordance with the preferred construction of the present invention is mounted within the doming ring die 28, with the inner end of the probe offset from the center of the lid 3 into alignment with the key neck portion 31 of the key 6, as shown in FIG. 2. The key 6 and staking in accordance with the conventional practice results in a U-shaped depression 32 encircling the connection post 21, with the adjacent neck portion 31 forming the outermost plane of the key.

The proximity sensor 27 is metal sensitive such that the presence and absence of a key 6 changes the output. The sensor 27 is interconnected into a monitoring and sensing circuit shown in FIG. 6.

During the conversion of the lid 3 and in particular the staking of the key 6 to the can lid, fine metal filings are generated. The successive feeding through the doming station 26 may result in an accumulation of such material on the proximity sensor 27, resulting in a malfunction. Thus, if such metal accumulates within the doming station and in particular on or immediately adjacent to the sensor 27, it will respond as if a key were present continuously even though, in fact, one or more of the successive lids passing through the station 26 do not carry a key 6.

The present invention also provides a means for continuously monitoring of the operation of the proximity sensor 27 to insure a failsafe detection system. More particularly, tool related signals are generated in timed relation to the signal of the proximity sensor 27 to insure that the output of the proximity sensor has changed during each can lid checking cycle. In the illustrated embodiment (FIGS. 1 and 4), a monitor signal disc 33 is coupled to the main tooling drive 9 and rotates in synchronism therewith. The drive coupling is selected to rotate disc 33 through 360° for each doming cycle of the ram 29. The signal disc is constructed as a continuous plate-like member having a quarter section removed, as at 34. Rotation of the disc 33 is angularly related to the position of the ram 29 shown by the small phantom pointer element 35 on the disc for purposes of illustration. Element 35 is generally midway of the removed section 34. The zero position of the ram 29 corresponds to top dead center while the 180° position corresponds to bottom dead center, as shown in FIGS. 4 and 5. Disc 33 actuates a latch check sensor such as a proximity sensor switch 36 and a reset proximity sensor such as a similar sensor 37 which is mounted in aligned relation to the periphery of the disc 33. When the disc 33 is aligned with the switches 36 and/or 37, the output is reduced to provide an essentially low or logic "0" signal and when the quarter section 34 is aligned with the switch, a logic "1" is generated. The switches are spaced by 180° and are appropriately located with respect to the angular cycle position of the ram 29, as illustrated in FIG. 5. The checking sensor 36 and the reset sensor 37 may be any suitable switching device. The sensors are small self-contained field sensor such as sold by Microswitch of Freeport, Ill. Model No. FYBCSEZ-2. The self-contained switches include a power transistor which is actuated by the change in the sensor field, as schematically shown and more fully described hereinafter in connection with FIG. 6.

Although the proximity key sensor 27 can be of any suitable construction, highly satisfactory units which can be readily mounted within the forming die 30 are sold by Industrial Solid State Controls, Inc., West Philadelphia Street, York, Pa. and more fully identified in their publication number 1240 and by Namco Controls, an Acme-Cleveland Co., of Cleveland, Ohio and more fully shown in their catalog series EE-76. The sensor 27 includes a tubular head 38 connected to a radio frequency generator, not shown, which generates a radio frequency field pattern 39 about the end of the head. When a metal key enters the radio frequency pattern the output of the sensor 27 decreases. The sensor is connected to a suitable electronic amplifier 40, as shown in FIG. 6, which provides on/off or opposite binary logic output signals in accordance with the presence and absence of the metal key 6. The amplifier 40 includes a normally on output terminal 41 and a normally off output terminal 42 for connection of such opposite logic signals into circuit. The amplifier 40 preferably is provided with a potentiometer 43 which permits the user to adjust the sensitivity of the sensor 27 for controlling the relative position of the key 6 with respect to the head 38 before switching occurs.

The tubular head 38 may be mounted within a metal support 45, such as shown in FIG. 3, with a sensing end flush with the base 30 without effecting the sensitivity of the head 38 to the position of the metal key 6 within the field.

Referring particularly to the across-the-line schematic circuit of FIG. 6, conventional A.C. input supply lines 46 and D.C. supply lines 47 are shown in vertical orientation with the various components connected in horizontal lines numbered consecutively as L-1 through L-23 from top to bottom on the left side of the drawing sheet. The corresponding numbers on the right side cross-reference the circuit elements to related elements in the lines.

Suitable key and sensor alarm lamps 48 and 49 are connected in series in lines L-1 and L-2 with normally closed contacts 50-1 and 51-1 of alarm relays 50 and 51. Relay 50 has a winding 52 in line L-18 which is normally energized and responds to the absence of a key 6 to close contacts 50-1. Relay 51 similarily has a winding 53 in line L-22. The winding 53 is normally energized and responds to a "dirty" sensor head 38 to close contacts 51-1. The A.C. input power is coupled to the amplifier 40 to provide appropriate energization thereof. Although not illustrated, a converter connected to lines 46 provides a suitable regulated D.C. power supplied to the D.C. lines 47 for energizing the sequence control circuitry connected to respond to the sensor 27 for controlling the relays 50 and 51 as shown in FIG. 6.

The probe head 38 is coupled to the switching amplifier 40 by a suitable coax cable at lines L3-L4 in FIG. 6. The output of the sensor amplifier 40 actuates a pair of relays 54 and 55 shown as phototransistor relays. The relay 54 includes a light emitting diode 56 connected in line L-5 to the output terminal 42. The diode 56 is coupled to a phototransistor 54-1 in line L-14, which with lines L-15 and L-16 forms a key latch circuit 57 which controls a key check circuit 58 including the relay 50. Phototransistor 54-1 is responsive to the light and is effectively non-conducting and therefore off in the absence of the the light and is biased to conduct or on whenever the associated lamp 56 is energized. Thus, the first phototransistor relay 54 has its lamp 56 connected in Line L-5 and the lamp is de-energized with the sensor 27 providing a low output; that is, without key 6 or other metal in the sensor field 39. When the key 6 or other metal member moves into the field 39 and reduces the sensor output, the amplifier output 42 goes high and LED 56 is energized and illuminates phototransistor 54-1 in line L-14 which closes the connection thereof to the positive D.C. line 47. An indicating lamp **58*a* is shown in Line L-6 connected in parallel with the LED to provide a visual indication on a control panel, not shown, indicating the operation of the relay 54. Phototransistor relay 55 functions in a similar manner in a probe check circuit 59 at lines L-22 and L-23**, as more fully described hereinafter.

Thus, when the dome forming ram 29 at the key check and dome station 26 reaches bottom dead center, the key 6, if present, is located immediately adjacent to the probe head 38, to energize the lamp 56 and complete the circuit in the line L-14 during the period that the key 6 is in the field 39. This state sequence is shown in the timing chart of FIG. 5 by trace 60, which is normally low and goes high as at 61 when a key 6 is detected. If the key 6 is not present, the signal remains low and phototransistors 54-1 is not energized, and the circuit at line L-14 remains open, indicating an improper can lid 4 which is reflected in the operation of the circuit. During this period, the timing disc 33 is in the position of FIG. 4E, with both the check sensor 36 and the reset sensor 37 covered and thus energized to hold the key checks circuit 57 and the probe check circuit 59 in a standby state. The state is shown by the high output of the related traces 62 and 63 in FIG. 5.

Line L-14 includes the phototransistor 54-1 as a series-connected switch with a resistor 58 across the D.C. lines 47 and also connected via a branch line 64 to control a pair of interlock phototransistor relays 65 and 66. Resistor 58 bleeds off leakage of transsistor 54-1 to prevent false turn-on of relays 65 and 66. Relay 65 and 66 include LED's or photodiodes 67 and 68 connected in parallel respectively in line L-15 and L-16, with branch line 64 connected between the common node of the phototransistor 54-1 and the resistor 58 and the inputs or anodes of the LED or photodiodes 67 and 68. Thus when the switch 54-1 is turned on, the LED's 67 and 68 are correspondingly energized. Relay 66 is a latching relay and includes a phototransistor 66-1 in line L-13, which closes and forms a by-pass around an LED 69 in Line L-12. LED 69 is the input of a reset relay 70 having switch phototransistor 70-1 connected in Line L-17 to hold LED's 67 and 68 off. The LED's 67 and 68 are also connected to the D.C. supply lines 47 through the line L-15 which includes a current limiting resistor 71 and a series connected blocking diode 72 between positive line 47 and branch line 64. Switch 70-1 in line L-17 is connected between the common node of the resistor 71 and diode 72 in line 15 and the negative side of the D.C. supply. The circuit through line L-15 is established only if the by-pass phototransistor 70-1 in Line L-17 is off. As described above phototransistor 70-1 is turned off by the key-related energizing of relay 66 and, thereby once energized relays 65 and 66 are latched in via line L-15. In this state, the relays 65 and 66 produce a high output as shown by trace 73 in FIG. 5 and the reset relay 70 is off or at a low output as shown by trace 74 in FIG. 5. Thus, with the reset switch 37 properly actuated by the timing disc, the relay 54 is operative to latch the relay 65 and 66 in circuit.

The circuit 57 also includes a set of contacts or switch 75 of a manual reset switch 76. Switch 75 is connected in line L-16 between positive line 47 and branch line 64. It provides for initial energizing of relays 65 and 66, which are also reset prior to the key sensing portion of the cycle, as hereinafter described, to provide for the above described latching sequence.

The relay 65 which is thus latched to lines 47 actuates the phototransistor 65-1 in Line L-20 of the key check alarm circuit including the missing key relay 50.

The relay 50 is illustrated as a conventional relay having winding 52 connected in line L-18 and coupled to actuate alarm contacts 50-1 in line L-1 and a second set of normally open contacts 50-2 in line L-19. The contacts 50-1 are normally closed and are held open by energizing of winding 52. When closed, they indicate a fault condition. Contacts 50-2 are connected to by-pass a manually operable and normally open switch 77, in line L-18, of the cycle start switch unit 76. The relay 50 may further control contacts 50-3 in a separate conversion stop unit **77*a***.

Relay winding 52 is connected to be energized initially by actuation of cycle start switch unit 76 which includes switch 77 in line L-18 in series with a phototransistor 78-1 of a relay 78. This relay 78 is controlled by the check sensor 36 and is held on except for a period immediately following the bottom dead center ram position, as shown in trace 62 of FIG. 5 and the timing disc positions of FIGS. 4E and 4A and subsequently discussed.

Thus, during start up, line L-18 is completed by momentary closing of switch 77 and relay winding 52 is energized. Contacts 50-2 close and latch-in the winding 52 as long as phototransistor 78-1 is conducting. An alternate holding circuit is established about phototransistor 78-1 by the conducting phototransistor 65-1 as follows.

A diode 78 or 79 interconnects the output side of the manual switch 75 and relay contacts 50-2 to the input of the phototransistor 65-1. The phototransistor 65-1 is also connected to the power lines 47 in series with an indicating LED 80 and a current limit 81 (line L-23) and a parallel leakage resistor 82 in line L-24. Thus, when relay 65 is energized by the latching circuit 57, relay phototransistor 65-1 conducts and provides an energizing circuit for relay winding 52, if such relay is already energized to close its contacts 50-2 as a result of the conducting phototransistor 78-1. This second holding circuit is of course created only if a key 6 is detected. This phototransistor relay 78 is controlled by the check sensor unit 36 and is normally on except for the period that the gap 34 in the timing disc 33 is aligned with the sensor unit 36, as shown by trace 62 in FIG. 5. Sensor unit 36 is still on during the period immediately following the bottom dead center position of the ram 29, as shown in FIG. 4E. Immediately following the key detecting period, the relay 78 is de-energized as a result of the alignment of the timing gap 34 in the timing disc 33 with the sensor 36. Thus, the sensor 36 controls a phototransistor 83 connected in line L-8 in series with an indicating LED 84 and a current limiting resistor 85. The relay 78 includes an LED 86 in line L-7 and connected to the transistor 83. LED 86 and therefore relay 78 is de-energized when the disc 33 rotates from position 4E to 4A and the transistor 78-1 turns off, as shown at 87 on trace 62 in FIG. 5. This opens the line L-18 to winding 52. If, however, a key 6 was detected the relay 65 was energized and holds relay winding 52 energized through its latching contacts 50-2, the diode 78 and the phototransistor 65-1 in line L-20. If a key 6 was not detected, however, and the relay 65 was not energized, this patch is not available and the above opening of line L-18 deenergizes the winding 52 of relay 50. Control contacts 50-1 and lamp 48 goes on, and contacts 50-3 open to terminate the press operation. Simultaneously, the latching contacts 50-2 open and require actuation of the manual reset switch unit 76 to again operate the conversion press apparatus. The immediate shut-down is desirable to allow the operator to check the machine. The check sensor is actuated at approximately 5° after ram BCD and produces a shut-down, in the event a key is missing, in a desirable position of the conversion apparatus.

If the key was present, of course, the relay 65 holds relay 50 energized during the ninety degree rotation of the timing plate or disc 33 from the checking state of FIG. 4A to the idle state of FIG. 4B. At this time, the checking sensor 36 is again energized, the relay 78 is reset and goes high as shown in FIG. 5 to hold the relay 50 energized even though the key sensing circuit is reset. During this period of time the ram, of course, is returning to top dead center and the timing disc 33 continues to rotate. The ram 29 reaches and moves past top dead center to start a new forming cycle. The timing disc 33 is rotated therewith to uncover the reset sensor 37, as shown in FIG. 4C, as the ram 29 starts to descend during this new forming cycle.

Sensor 37 includes a phototransistor 90 in line L-11 in series with an indicating LED 91 and a resistor 92. An LED 93 of a reset relay 94 is connected in line L-9 and also connected in series with the sensor transistor 90. The phototransistor 93-1 of relay 93 is connected in line L-13 in series with the latching relay transistor 66-1. When transistor 93-1 is turned off, line L-13 opens; thereby opening the by-pass circuit about the LED 69, in line L-12, of the phototransistor relay 70. The LED 69 is then energized and actuates its phototransistor 70-1 in line L-17. This establishes a current by-pass path from line L-15 on the anode side of the diode 72 and shunts current from the LEDs 67 and 68 of the relays 65 and 66. The relays thereby turn off and are held off as long as the phototransistor relay 70 is held energized. This then resets the circuit for a subsequent cycle.

The key sensitive relay 54 has, of course, been de-energized as shown by trace 60.

The above sequence assumes that the key sensor 38 operates properly. If, however, there is an accumulation of metal fines or the like about the sensor head 38, a false signal is generated which holds LED 56 of relay 54 on, and phototransistor 54-1 is line L-14 energized such that the relay 65 and 66 are held on. Relay 66 is latched into circuit in the same manner as if a key 6 were present and holds alarm relay winding 52 energized. This, of course, is a false signal because keyless lids 4 may be passing through the apparatus.

The LED 95 of the phototransistor relay 55 is connected to the normally high output of the sensing amplifier 40, as shown by trace 96 in FIG. 5. The output decreases, as at 97, when a key 6 is detected. The LED 95 is coupled to a phototransistor 55-1 connected in line L-22 to energize winding 53 of fault relay 51. The winding 53 and transistor 55-1 are connected in series in line L-22 with a set of normally open contacts or switch 98 of the manual reset switch 76. A pair of latching contacts 51-2 of the relay 51 are connected in line L-23 and in parallel with the manual reset switch 98. Thus, the relay 51 is normally held energized through transistor 55-1 except for the period of time that a key 6 is detected, or a false key signal is created by metal fines or particles on the head 38 which so change the field 39 as to simulate presence of a key 6. During the key check period a phototransistor relay 99 which is controlled by the reset sensor 37 in line L-11 provide for a current path to relay winding 53 as follows. Relay 99 includes a monitoring phototransistor 99-1 in line L-23 which is connected in parallel with transistor 55-1. An LED 100 of relay 99 is connected in line L-10 which in turn is connected to the reset transistor 90 in line L-11. Thus, relay 99 is de-energized in synchronism with the key circuit reset relay 93 during the period that the reset sensor 37 is aligned with the gap 34 in the timing disc 33, as shown in FIGS. 4C and 4D and at 101 in the trace 102 for relay 99 in FIG. 5. This period coincides with the intermediate downward ram movement and essentially covers the period of the movement of the ram from just past top dead center through approximately 90°. In this period, a clean sensor head 38 produces a relatively high output and amplifier 40 similarly energizes the phototransistor relay 55, as shown by trace 96.

If, however, the probe head 38 is dirty, the output is held low, as shown at 103 on trace 96 and the phototransistor relay 55 is de-energized. When the reset phototransistor relay 99 is de-energized as a result of the movement of the timing disc gap 34 into alignment with the sensor 37, the latching circuit at line L-23 opens and thus both lines L-22 and L-23 to winding 53 are open. The relay 53 drops out, and opens the power control contacts 51-3 (1-17) in the press circuit. This immediately shuts down the conversion apparatus in the same manner as if a missing key had been detected. The contacts 51-2 (1-23) in the latching circuit about the manual reset switch 98 also opens and require manual restart.

Thus, the probe monitor circuit 59 includes the normal latching provided by proper output of the probe sensor and checking by the reset means during a period other than when the sensor is functioning to detect a key 6. The probe monitor circuit 59 thus monitors the buildup of the aluminum filings and the like on the key sensor during each cycle.

Thus, the lid conversion apparatus cyclically operates, with the key detection circuit 57 operable during a ninety degree time period or window established with the disc rotating through stages 4D, 4E, and 4A of FIG. 4 and the probe condition circuit 59 operable during a ninety degree time period or window established with the disc rotating through stages 4C and 4D, to provide a proper key check sequence as the keyed lids move through the doming station 26. If a key is missing or the sensor malfunctions open, circuit 57 is not latched and, the press shuts down, indicating the lack of a key. If the key is present but the probe 27 is dirty or malfunctions closed the circuit continues to operate till the probe check circuit 59 is reset circuit and then shuts down.

In the illustrated embodiment of the invention, the monitoring means includes the sensing head which produces similar outputs in the presence of the key or foreign matter such as metal fines. To insure continued control and detection, the monitoring means includes means for generating, within each cycle of the lid forming means, a key detection period during which a signal must be generated and a second period during which a "dirty" sensor detection period during which such signal must not appear. Thus, each cycle includes at least two separate periods or checking "windows" to provide continuous monitor of they key detect system. The two periods also provide an automatic fail-safe detection system. Thus, if the sensor fails open, it actuates the alarm during one period and if it fails closed, it actuates the alarm during the opposite period.

Although the illustrated embodiment discloses a highly satisfactory system, other means can of course be employed within the scope of the present invention to generate the two distinct periods within each cycle. For example, a computing device, such as the recently developed microprocessors may be used to respond to the output of the tool-mounted sensor and monitor the creation of the key-related signal and the required change in the sensor signal to determine provided circuit operation. Other timing means such as a rotating digital encoder may be employed to produce the appropriate checking periods during each cycle.

The D.C. sensing and shut down control circuit is somewhat more responsive than an A.C. circuit. During the staking, key 6 is whipped inside of the tooling which reduces the available sensing time within which the properly staked key is present in the sensing field 39. Thus, in an actual construction a control operated with an A.C. switching circuit was satisfactory for processing approximately 200 lids per minute but malfunctioned when the speed was increased to 240 lids per minute.

The present invention thus provides a highly improved fail-safe system for monitoring the presence of the key and the condition of the sensing probe.

Various modes of carrying out the invention are contemplated as being within the scope of the following claims, particularly pointing out and distinctly claiming the subject matter which is regarded as the invention.

I claim:

1. In a can lid forming apparatus having a cyclically operated tooling means for sequential forming of a series of metal keyed lids each having an outer metal key means, monitoring means for checking the presence of the key means, comprising a key sensor located within the tooling means and establishing a sensing field within the tooling means to produce a first output in the absence of the key means and a second output in the presence of the key means, said tooling means being operable to locate the key means in said sensing field during a sense portion of each cycle of the tooling means whereby a pulse signal is generated during each lid forming cycle, a check sensor means operable to generate a hold signal during the forming cycle of the tooling means including said sense portion of each cycle and a check signal at a selected non-sense portion of the forming cycle, latch means connected to said sensor and latched in response to said second output of said key sensor, and control means connected to said latch means and to said check sensor and providing an indication of the presence of the key means only in response to sequential operation of the latch means and the check means, a reset means connected to reset said latch means and including a reset sensor coupled to the tooling means and located to produce a reset signal at a predetermined position of the tooling means following the check signal of the check sensor, and a sensor state monitor means connected to continuously monitor the establishing of said first and second outputs and to generate an output signal in response to said second output during a selected non-sense protion of the forming cycle.

2. The apparatus of claim 1 wherein said reset means is connected in said sensor state monitor means to generate said output signal in the presence of said second output.

3. In the apparatus of claim 1 wherein said tooling means is a doming means having a die adapted to support a keyed lid with the key located within the die and a reciprocating ram moving the lid into the die, said key sensor being located within said die in opposed relation to said key position and responsive to the inward movement of the key.

4. In the apparatus of claim 3 wherein said key is staked to said lid with an offset key portion at the connection, said sensor being located within the die in alignment with said offset key portion.

5. In the apparatus of claim 3 wherein said die is a cup-shaped member having a central, essentially flat base portion, said sensor being releasably mounted within said base portion with the upper end of the sensor in the plane of said base portion, said sensor establishing said sensing field projecting outwardly into said cup-shaped member.

6. In the apparatus of claim 5 wherein said sensor is a cylindrical member having a flat sensing end, and a holder is releasably mounted within said die for positioning the flat sensing end relative to said base.

7. In the lid forming apparatus of claim 1 wherein said latch means includes a relay means connected to said key sensor and relay switch means connected in circuit with a latch relay means having latch switch means, said control means including an output means connected in circuit with latch switch means, said check sensor means including a check relay means having check switch means connected in parallel with said latch switch means whereby said output means is operable by either of the paralleled switch means.

8. In the lid forming apparatus of claim 7 wherein said reset means includes a reset relay means having switch means connected to reset said latch relay means, and a reset interlock relay means connected in circuit with said reset sensor and having interlock switch means connected in circuit with said latch switch means across said reset relay means to conjointly control energization of the reset relay means.

9. In the lid forming apparatus of claim 1 wherein said sensing state monitor means includes an output means and a key relay means connected to said key sensor and having control switch means connected in circuit with said output means, and a control switch means connected in parallel with said control switch means whereby said output means is operable by either of the parallel switch means, said control switch means being operated during the non-sense portion of the tooling cycle to actuate the output means in response to the presence of the second output of the key sensor.

10. In the lid forming apparatus of claim 1 wherein said latch means includes a relay means connected to said key sensor and relay switch means connected in circuit with a latch relay means having latch switch means, said control means including an output means connected in circuit with latch switch means, said check sensor means including a check relay means having check switch means connected in parallel with said latch switch means whereby said output means is operable by either of the paralleled switch means, said reset means includes a reset relay means having switch means connected to reset said latch relay means, a reset interlock relay means connected in circuit with said reset sensor and having interlock switch means connected in circuit with said latch switch means across said reset relay means to conjointly control energization of the reset relay means, said sensing state monitor means includes an output means and a key relay means connected to said key sensor and having control switch means connected in circuit with said output means, and said reset relay means includes switch means connected in parallel with said control switch means whereby said output means is operable by either of the parallel switch means to actuate the output means in response to the presence of the second output of the key sensor during the non-sense portion of the tooling cycle.

11. In the apparatus of claim 10 wherein said tooling means is a doming means having a die adapted to support a keyed lid with the key located within the die and a reciprocating ram moving the lid into the die, said key sensor being located within said die in opposed relation to said key position and responsive to the inward movement of the key.

12. In the apparatus of claim 11 wherein said die is a cup-shaped member having a central essentially flat base portion, said sensor being releasably mounted within said base portion with the upper end of the sensor in the plane of said base portion, said sensor establishing said sensing field projecting outwardly into said cup-shaped member.

13. A monitor apparatus for detecting the presence of a member, comprising a sensing means producing a unique signal in response to presence of the material of said member, means for relatively moving the member past the sensing means to generate a unique signal, a monitoring circuit having a latch means to set the circuit and a check means to monitor the state of latch means, means connecting the latch means to the sensing means to respond to the unique signal, means connected to sense said relative movement of the member and connected to actuate the check means after the member is removed from the sensing means, and means to reset the latch means.

14. The monitor apparatus of claim 1 including a sensor state monitoring circuit having a control means having an input means responsive to the unique output of the sensing means to condition the control means for actuation, and test means responsive to separation of the member from the sensing means to actuate said first means in the presence of said unique signal at said input means.

15. The monitor apparatus of claim 1 including a forming means including a die and a forming tool means mounted for relative movement, means to locate the member in said die, said sensing means being located within the die, said tool means moving the member into the die and toward the sensing means.

16. The monitor apparatus of claim 3 wherein said sensing means creates a field and said member distorts said field to create said unique signal.

17. A monitor apparatus for detecting the presence of a moving member, comprising sensing means to produce a first output in the presence of the member or other foreign matter equivalent to a member and a second output in the absence of the member, first control means connected to said sensing means and responsive to the output of the sensing means to signal the loss of said member, second control means connected to said sensing means and responsive to said first output in the absence of said member and the presence of said foreign matter to produce an output, wherein said first means includes a control circuit having an output means and a first cyclical means responsive to the movement of the member to actuate the output means between the alignment of successive members with the sensing means, said control circuit including a latch means, said sensing means being connected to actuate said latch means and actuate the output means during the period of alignment of a member with the sensing means, and a second cyclical means connected to reset said latch means during the period the first cyclical means actuates the output means.

18. The monitor apparatus of claim 17 wherein said second control means includes a control circuit having an output means connected to said sensing means for actuation by said second output and connected to second cyclical means for actuation during the period a member moves past the sensing means.

19. In a key staking and lid conversion apparatus having a doming press for doming of a keyed can lid with a ram engaging the underside of a lid and forcing the center portion of the lid into a die, a sensor mounted within the die and establishing a sensing field within said die and within a space in which the metal key of a lid is located during the forming operation, an amplifier connected to said sensor and providing a switching output including a normally open output and a normally closed output which are reversed in the presence of said key in said field, a key check relay connected to said normally open output and having key check switch, a key check interlock circuit including a latch relay in a series latch circuit with switch means of said key check relay for energization in response to the pulsed actuation of the key check relay, a turn-off relay having switch means connected to open said latch circuit and including a normally energized relay input means, a cycle control means including a first check sensor located to provide binary logic output signals with the signal changing following the alignment of the key with the sensor field and operable for a preselected portion of the return forming cycle and a reset sensor providing binary logic output signals for a similar portion of a cycle offset by essentially 180° from the check sensor, a reset relay having a switch connected in circuit with switch means of said latch relay across said relay input means, said reset sensor including a switch means coupled to energize said turn-off relay, a stop circuit including a control relay connected in circuit through self-latching contacts and a switch of the latch relay, said check relay including an input means connected in circuit with the check sensor and having a switch connected in circuit to the control relay and providing an energizing circuit in parallel with the latch switch, said reset sensor being operable to deenergize the input means of said latch relay for a period immediately following the key check period whereby said control relay is deenergized if the latch relay is not energized, a probe monitoring relay connected to said normally closed output of said amplifier, a probe monitor circuit including a probe control relay connected in circuit by self-latching contacts and interlock switch means of said probe monitor photosensitive relay, said reset means including a switch connected in parallel with last named interlock switch to effectively by-pass the key sensor switch during the key sense cycle portion and to open said by-pass during the reset cycle thereby providing an automatic checking on the establishing of the first output of the key sensor means.

20. In the apparatus of claim 19 wherein said cycle control means includes a timing disc operated in synchronism with the working stroke and the return stroke of the ram, said check sensor and said reset sensor being proximity sensors mounted to circumferentially spaced locations of said disc, said disc having spaced operating means for actuating said proximity sensors to define said binary logic signals, during each complete forming cycle.

21. In the apparatus of claim 20 wherein said sensors include phototransistor switches controlled by said proximity sensors, each of said key check relays, said latch relay, said turn-off relay and said reset relay including a phototransistor switch actuated by an input operating diode to turn said phototransistor switch on and off.

22. In a key can lid conversion apparatus, having a lid forming means for the shaping of said can lid, key monitoring means mounted within said forming means and having a sensing head aligned with the key with the can lid located in the formed position within said forming means, said sensing head being continuously spaced from said key and generating a field in the area of said key during the shaping operation whereby the output of the sensor varies with the movement of the key during a selected portion of the shaping operation.

23. In the can lid forming apparatus of claim 22 wherein said forming means includes a doming die having an encircling ring portion and a base portion defining an interior cavity, said can lid being located on said ring die in an inverted position with the key located within the ring die, and a ram means adapted to move into the die and to move said can lid downwardly to form a domed portion with said key moving inwardly within said cavity and located at the innermost position in spaced relation to the base of the die, the proximity sensor mounted within the base portion of the die and having a head means located generally in the plane of the base portion and generating a field projecting upwardly into the cavity, said key member moving downwardly into said field in response to the forming of said dome portion.

24. The method of detecting the presence of a member comprising generating in a sensing means a first unique signal with the member present and a second unique signal with the member removed and thereby providing cyclical outputs in response to the spaced movement of a series of the members through the sensing means, generating a series of control signals, setting a first period in response to a first control signal in which to respond to said first unique signal and recording such response by the setting of a latch circuit by said first signal, subsequently checking the setting of said latch circuit and generating said first unique signal in response to a second control signal and generating a fault signal if the said signal is not received and resetting said latch circuit if the first signal is received, and establishing a second period in which to respond to said second signal and recording of such second signal by actuating a probe by-pass circuit connected about a release circuit which is deactivated by said resetting of the latch circuit to detect the absence of said first unique signal during the resetting of said latch circuit, said second period being created between the movement of the members into the sensing means and detecting accumulation of foreign matter simulating the presence of a member.

25. The method of claim 24 including moving the member into said sensing means with a shaping tool to simultaneously shape the member.

26. The method of claim 25 including the steps of forming a metal responsive field and positioning said member within said field to create said unique signal, and detecting the output of said field.

27. In a key can lid conversion apparatus, having a lid forming means for the shaping of said can lid, key monitoring means mounted within said forming means and having a sensing head aligned with the key with the can lid located in said forming means, said sensing head generating a field in the area of said key during the shaping operation whereby the output of the sensor varies with the movement of the key during a selected portion of the shaping cycle operation. Said monitoring means including a control means generating first and second signal periods during each cycle, said first period actuating the monitoring means to respond to the sensor output created by a key to detect the presence of a key, and said second period actuating the monitoring means to respond to the sensor output created by foreign matter simulating a key in said field.

28. The apparatus of claim 27, wherein a sensor malfunction actuating said the monitoring means during said first and second periods.

29. In the apparatus of claim 27, wherein said sensor generates a field projecting into the tooling and said key member is located within the field in spaced relation to said sensor, said sensor providing a first level signal in the presence of said key and a second constant level signal in the absence of said key member, said monitoring means including logic circuit means connected to said sensor, said logic circuit means being biased to create an alarm output during each of said periods and being held off by said constant level signals.

30. In the apparatus of claim 29, wherein said logic circuit means includes individual alarm circuits for each of said periods, each of said circuit including first switching means actuated to an alarm state during each of said corresponding periods and said sensor being operable to by-pass said switching means by generating of said constant level signals.

* * * * *

UNITED STATES PATENT AND TRADEMARK OFFICE

CERTIFICATE OF CORRECTION

PATENT NO. : 4,140,072

DATED : February 20, 1979

INVENTOR(S) : ARTHUR A. BARTLING ET AL

It is certified that error appears in the above-identified patent and that said Letters Patent are hereby corrected as shown below:

| | | |
|---|---|---|
| (Column 2, | Line 21, | At beginning of sentence cancel "sensor" and substitute therefore --- sensors ---; |
| Column 2, | Line 31, | After "monitor" cancel "curcuit" and insert --- circuit ---; |
| Column 3, | Line 19, | After "herewith" cancel "illustrates" and substitute therefore --- illustrate ---; |
| Column 6, | Line 24, | After "field" cancel "sensor" and substitute therefore --- sensors ---; |

UNITED STATES PATENT AND TRADEMARK OFFICE

CERTIFICATE OF CORRECTION

PATENT NO. : 4,140,072

DATED : February 20, 1979

INVENTOR(S) : ARTHUR A. BARTLING ET AL

It is certified that error appears in the above-identified patent and that said Letters Patent are hereby corrected as shown below:

| | | |
|---|---|---|
| Column 7, | Line 54, | After "and" cancel "phototransistors" and substitute therefore --- phototransistor |
| Column 10, | Line 65, | After "also" cancel "opens" and insert --- open ---; |
| Column 11, | Lines 16-19, | Insert a comma (,) after "closed"; |
| Column 11, | Line 31, | After "of" cancel "they" and insert --- the ---; |

UNITED STATES PATENT AND TRADEMARK OFFICE

CERTIFICATE OF CORRECTION

PATENT NO. : 4,140,072

DATED : February 20, 1979

INVENTOR(S) : ARTHUR A. BARTLING ET AL

It is certified that error appears in the above-identified patent and that said Letters Patent are hereby corrected as shown below:

| | | |
|---|---|---|
| Column 12, CLAIM 1 | Line 28, | After "non-sense" cancel "protion" and substitute therefore --- portion ---; |
| Column 14, CLAIM 14 | Line 3, | After "claim" cancel "1" and substitute therefore --- 13 ---; |
| Column 14, CLAIM 15 | Line 11, | After "claim" cancel "1" and substitute therefore --- 13 ---; |
| Column 14, CLAIM 16 | Line 17, | After "claim" cancel "3" and substitute therefore --- 15 ---; |

UNITED STATES PATENT AND TRADEMARK OFFICE

CERTIFICATE OF CORRECTION

PATENT NO. : 4,140,072
DATED : February 20, 1979
INVENTOR(S) : ARTHUR A. BARTLING ET AL It is certified that error appears in the above-identified patent and that said Letters Patent are hereby corrected as shown below:

| | | |
|---|---|---|
| Column 16, CLAIM 27 | Line 41, | After "operation" cancel the period "." as well as "Said" and substitute therefore --- said ---; |
| Column 16, CLAIM 30 | Line 63 | After "said" cancel "circuit" and substitute therefore --- circuits ---. |

Signed and Sealed this

*Twelfth* Day of *February 1980*

[SEAL]

*Attest:*

*Attesting Officer*

SIDNEY A. DIAMOND

*Commissioner of Patents and Trademarks*